US006068587A

United States Patent [19]

Huang

[11] Patent Number: 6,068,587

[45] Date of Patent: May 30, 2000

[54] CENTRIFUGAL SEPARATOR FOR SEPARATING SOLIDS AND LIQUIDS IN A SLURRY

[76] Inventor: Min-Yen Huang, No. 599, Kuo-Min Rd., South dist., Tainan City, Taiwan

[21] Appl. No.: 09/386,473

[22] Filed: Aug. 31, 1999

[51] Int. Cl.[7] ..... B04B 1/04; B04B 7/04; B04B 11/04

[52] U.S. Cl. ..... 494/48; 494/60; 494/67; 494/79

[58] Field of Search ..... 494/74, 79, 36, 494/43, 47, 48, 56, 60, 67, 902

[56] References Cited

U.S. PATENT DOCUMENTS

| | | | |
|---|---|---|---|
| 622,712 | 4/1899 | Rissmuller | 494/48 |
| 686,917 | 11/1901 | Baker | 494/48 |
| 1,585,393 | 5/1926 | Laughlin | 494/67 |
| 1,640,707 | 8/1927 | Laughlin | 494/67 |
| 1,947,844 | 2/1934 | Gish | 494/48 |
| 2,233,855 | 3/1941 | Suss | 494/48 |
| 2,353,983 | 7/1944 | Banning | 494/67 |
| 3,256,993 | 6/1966 | Siepe et al. | 494/47 |
| 3,765,600 | 10/1973 | Steimel | 494/48 |
| 4,044,944 | 8/1977 | Moebus et al. | 494/48 |
| 4,085,889 | 4/1978 | Steimel | 494/48 |
| 4,347,971 | 9/1982 | Novoselac | 494/48 |
| 4,468,215 | 8/1984 | Wimmer | 494/48 |
| 5,441,475 | 8/1995 | Storruste et al. | 494/48 |
| 5,484,383 | 1/1996 | Fitch Jr. et al. | 494/67 |

FOREIGN PATENT DOCUMENTS

| | | | |
|---|---|---|---|
| 1296184 | 5/1962 | France | 494/47 |
| 46-7872 | 2/1971 | Japan | 494/47 |

*Primary Examiner*—Charles E. Cooley
*Attorney, Agent, or Firm*—Dougherty & Troxell

[57] ABSTRACT

A centrifugal separator for separating solid from liquid comprises a stand, a lower cover, a leaf-blade base, an upper cover, a fender wall, and a scrape assembly. The centrifugal force produced by high-speed rotation of the upper and the lower cover enables a plurality of steel beads to create a squeezing force that is used to balance the pressure exerted on the upper cover by the thrown residue B. By foregoing organization, control of the squeezed pressure as well as thrown quantity of the residue which escapes from the gap C between the upper and the lower cover is possible. Moreover, the separated water will be drained via a drain-pipe in order to separate the slurry completely for time and labor cost saving.

2 Claims, 7 Drawing Sheets

CENTRIFUGAL SEPARATOR FOR SEPARATING SOLIDS AND LIQUIDS IN A SLURRY

BACKGROUND OF THE INVENTION

As shown in FIG. 1, a conventional centrifuge 10 contains a dehydration tank 12 driven by a motor 11, wherein the cylindrical dehydration tank 12 comprises a plurality of dehydration outlets 120 and an internal filter felt 13 for filtering out slurry residue A to prevent the same from flowing away with water. During operation for separating the slurry, the motor 11 is started to drive the dehydration tank 12 to rotate in high speed, the water included will be filtered and drained through the dehydration outlets 120 due to centrifugal force while the slurry residue B will attach to the internal filter felt 13 and require labor for removal that costs extra time and expenditure to depart from economic rules.

In view of the above imperfection, the inventor is benefited with years of experience in related field to have an improved mechanism of this invention developed and proposed.

SUMMARY OF THE INVENTION

This invention relates to a centrifugal separator for separating solid from liquid, particularly to a centrifugal separator that avails itself of high speed rotation of an upper and a lower cover to produce centrifuigal force that enables a plurality of steel beads to create squeezing force to adjust pressure caused by accumulating slurry on the upper cover, so that the squeezed pressure and quantity of the thrown residue may be controlled.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

The primary object of this invention is to provide a centrifugal separator for separating solid from liquid, wherein the pressure of slurry accumulated at an upper cover is adjustable for controlling squeezed pressure and quantity of the thrown residue in order to save time and labor. At least a preferred embodiment will be elucidated below with reference to the annexed drawings.

Figure 1:
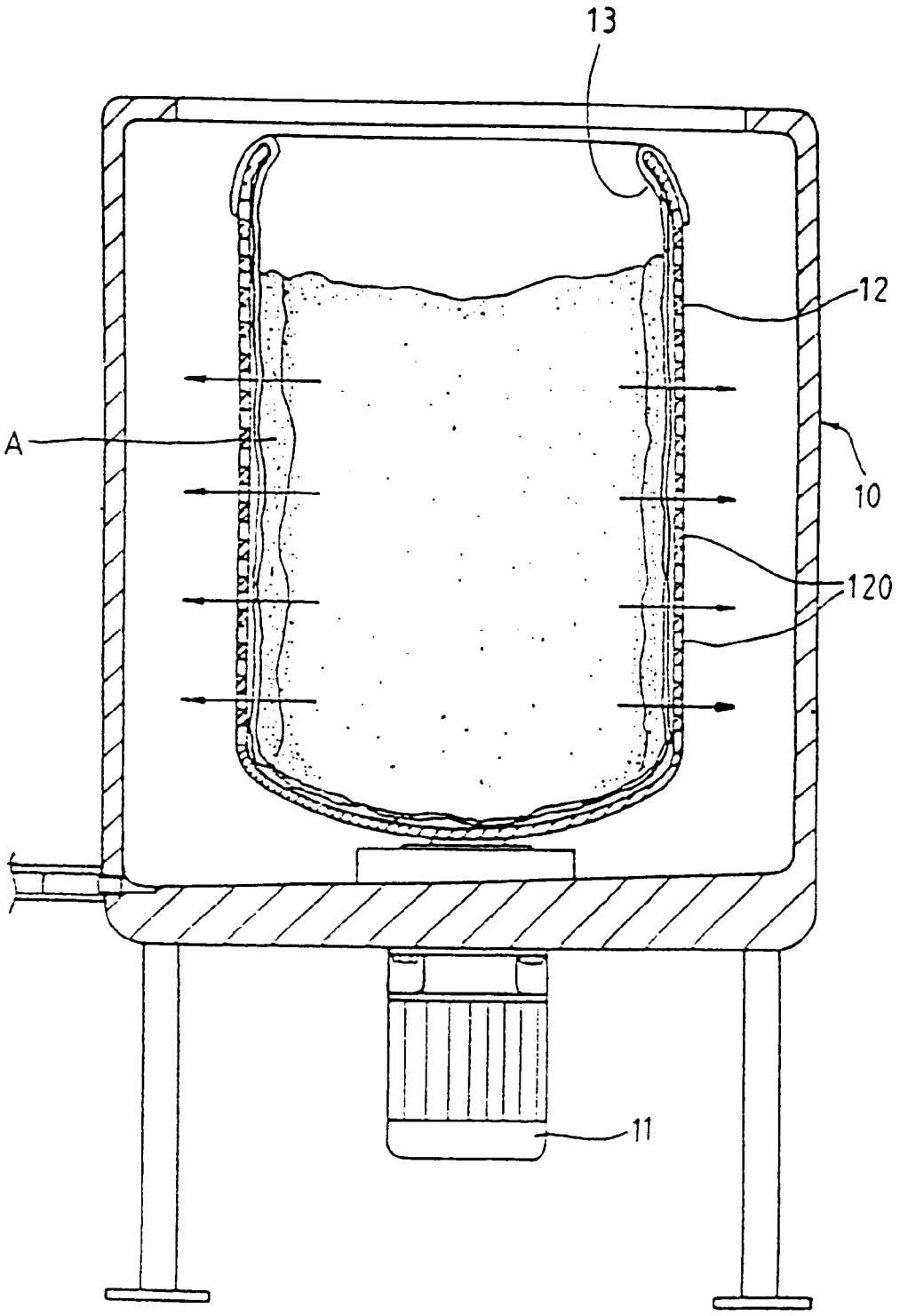
FIG.1 PRIOR ART
FIG. 1 is a schematic view of a prior centrifugal separator.
Figure 2:
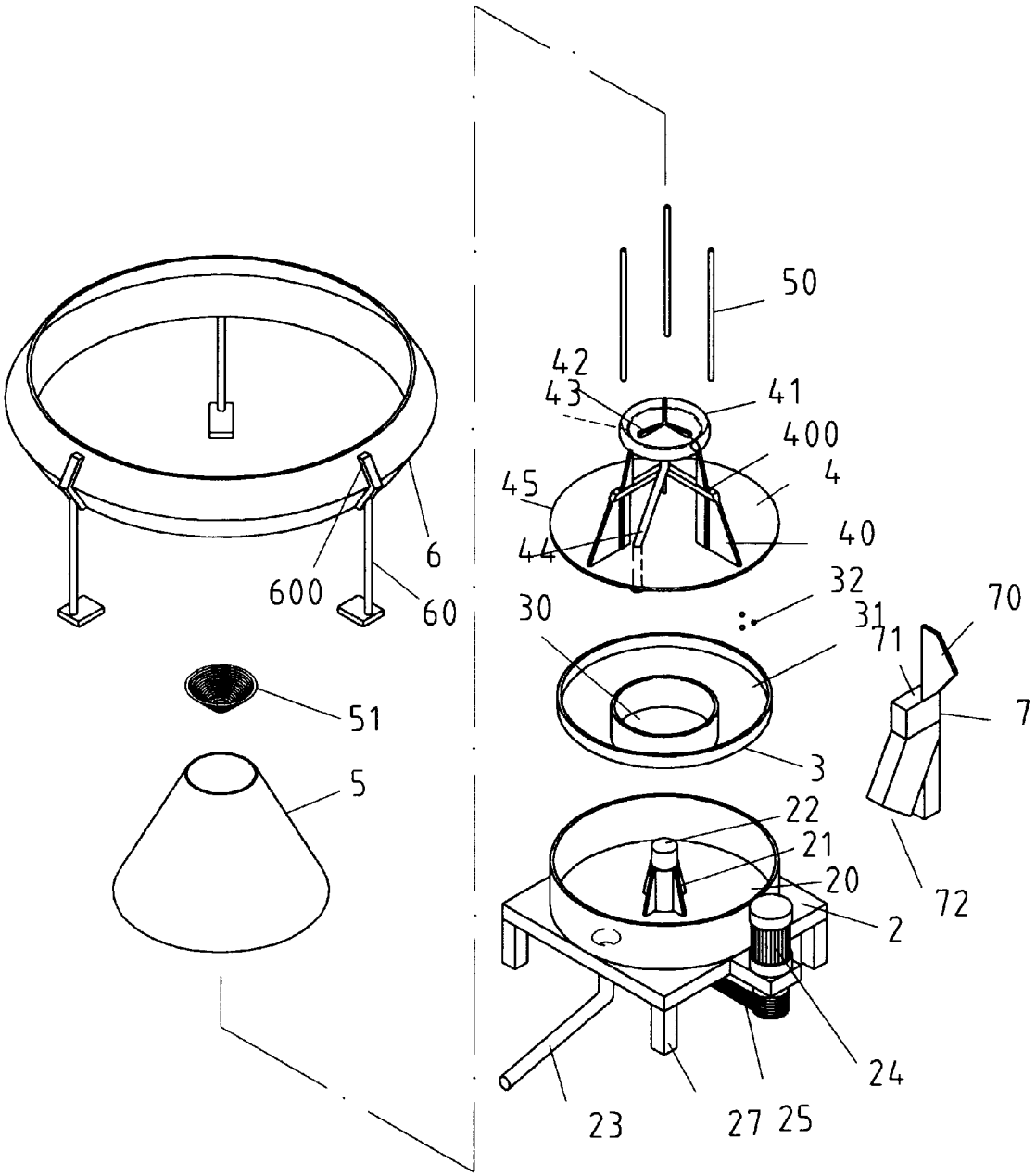
FIG. 2 is a three-dimensional exploded view of this invention.
Figure 3:
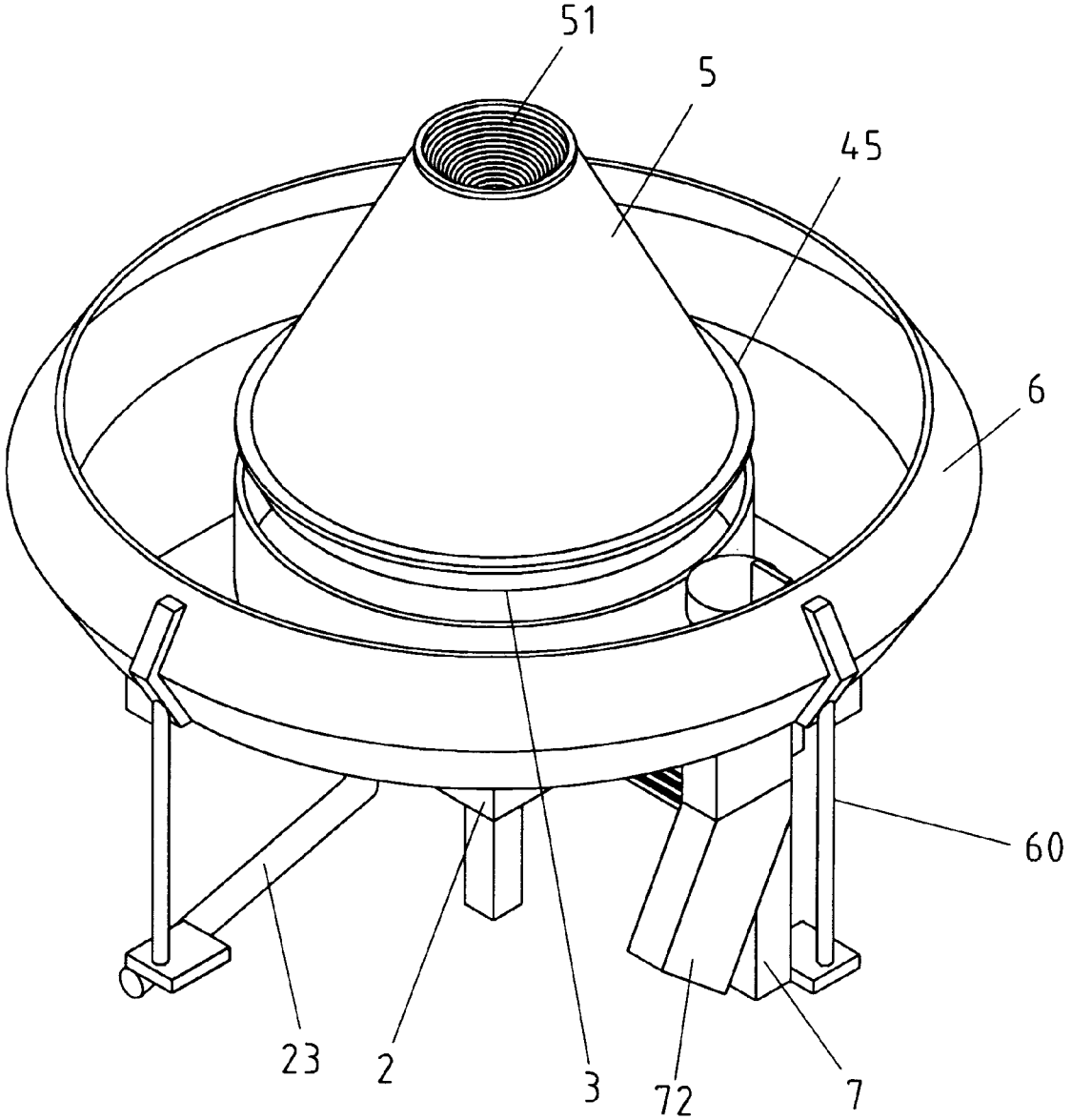
FIG. 3 is a three-dimensional assembled view of this invention.
Figure 4:
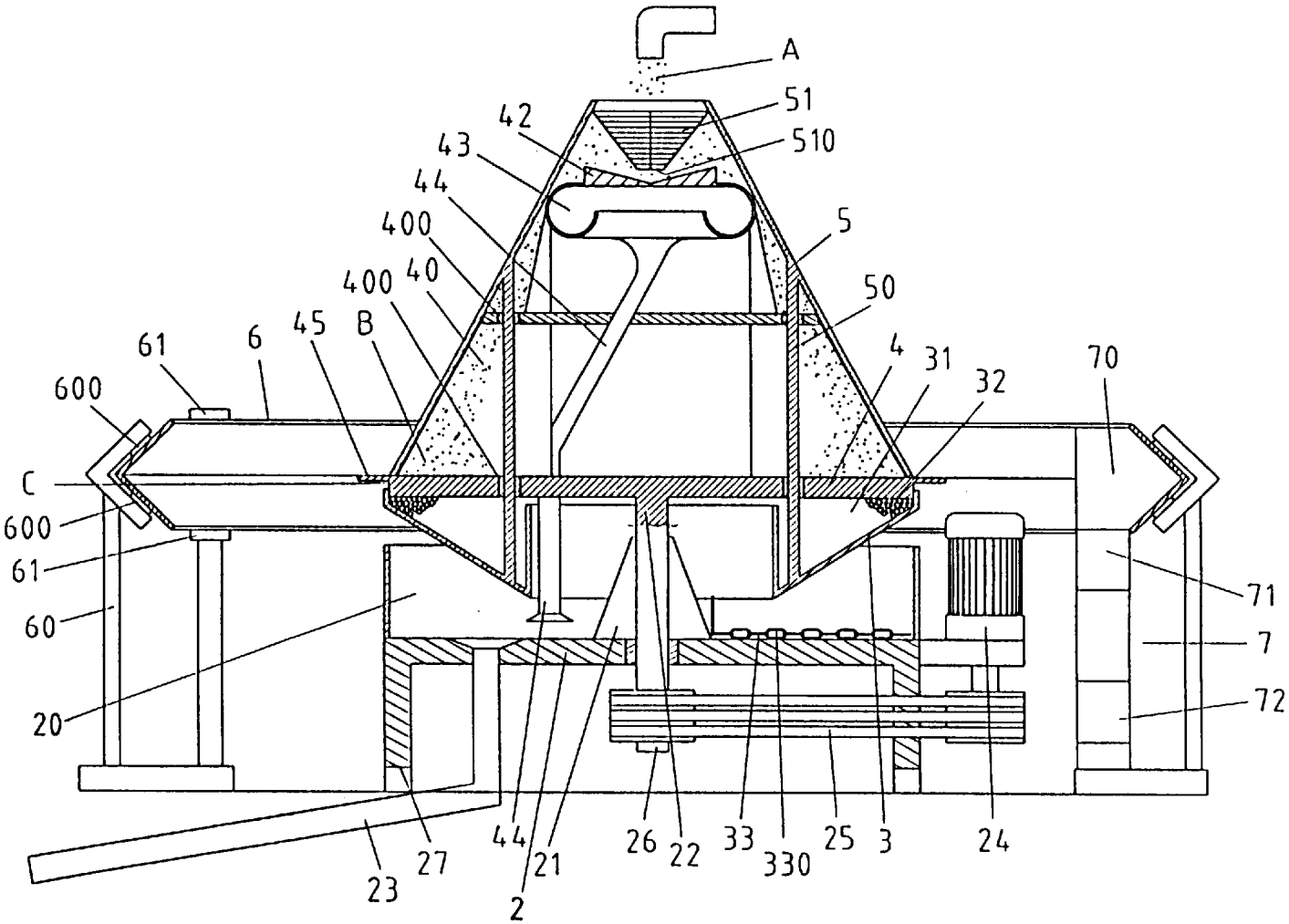
FIG. 4 is a schematic view showing close state of a gap between an upper and a lower cover of this invention.
Figure 5:
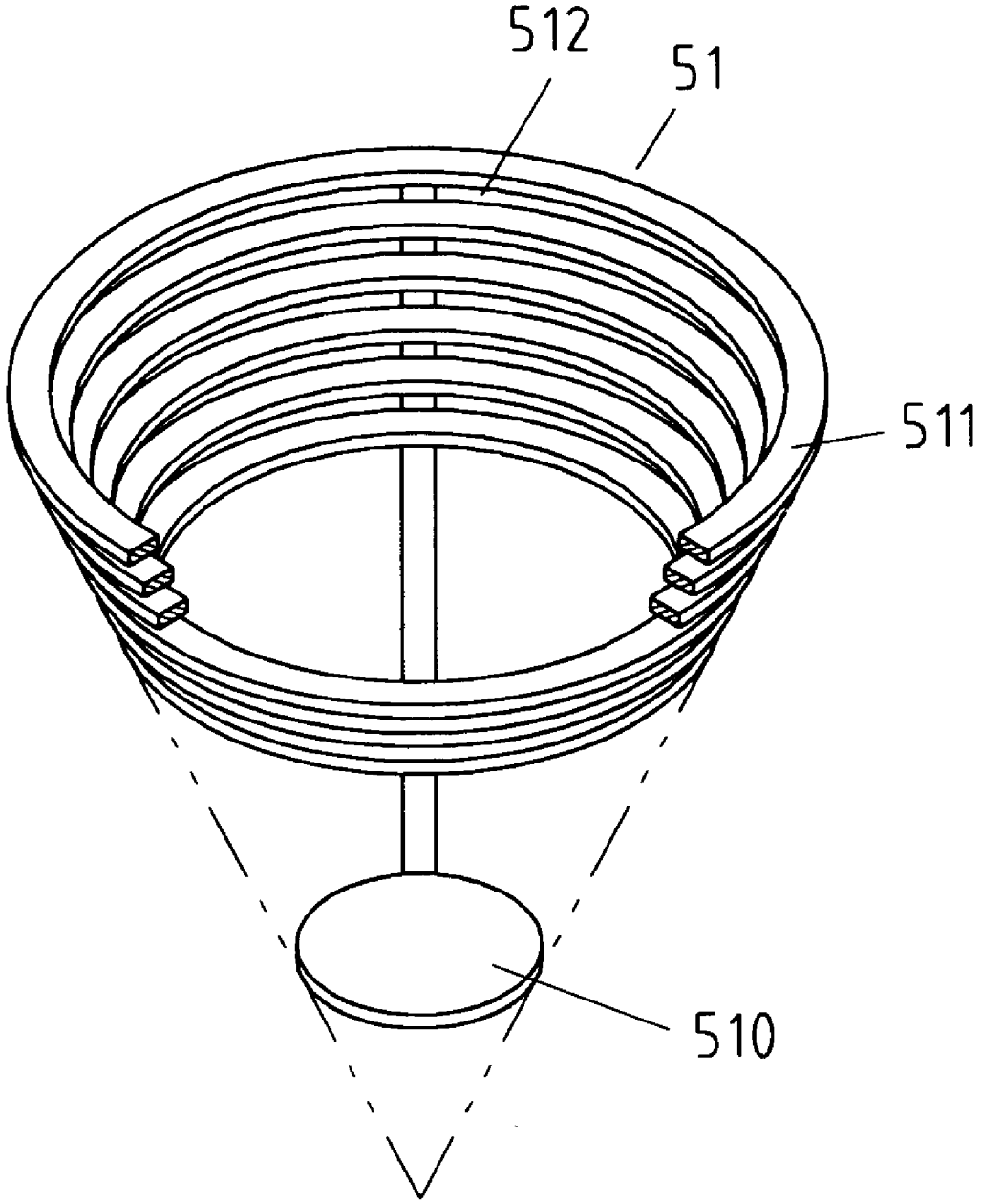
FIG. 5 is a schematic three-dimensional view of a flow-guide funnel of this invention.
Figure 6:
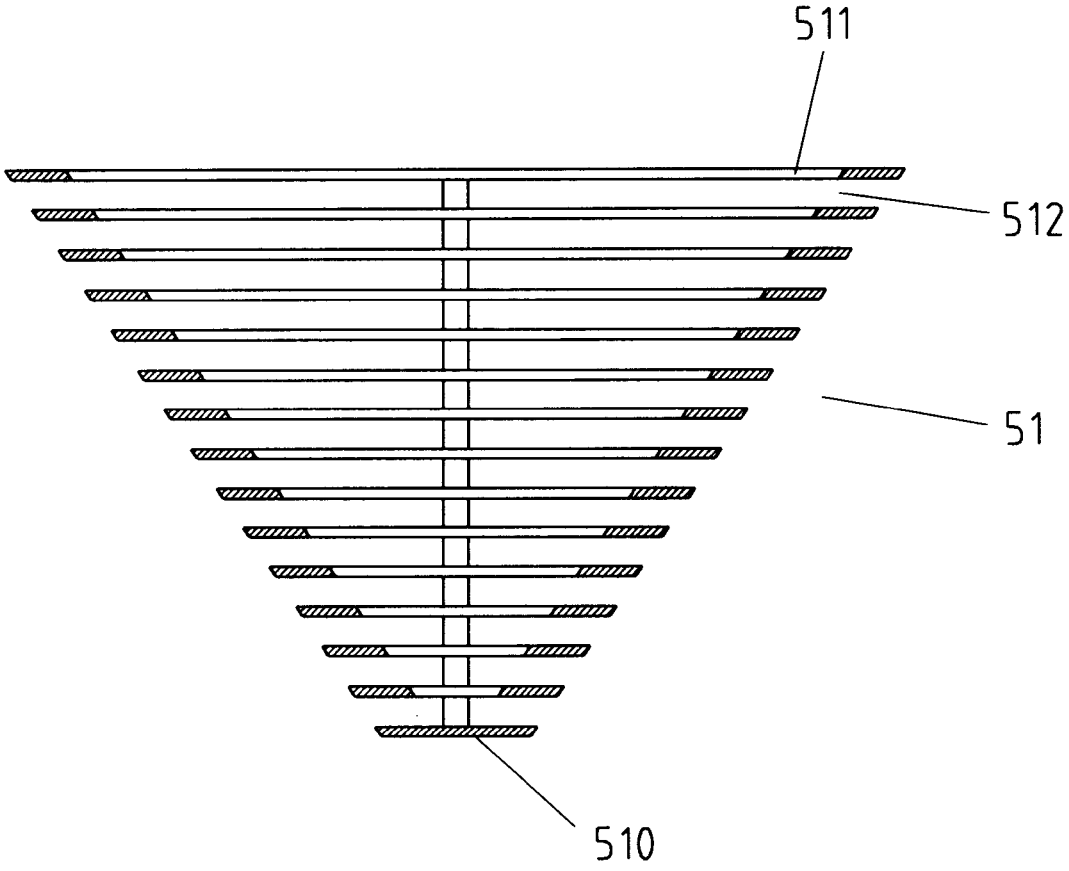
FIG. 6 is a schematic cutaway sectional view of the flow-guide funnel of this invention.

First, as shown in FIG. 2 and 3, this invention mainly comprises a stand 2 and a reservoir 20 disposed on the stand 2. The reservoir 20 contains a plurality of rotatable leaf blades 21 10 inside whereon a connecting portion 22 is disposed, and a drainpipe 23 as well as a motor 24 is located under and by the reservoir 20 respectively. The motor 24 is to drive a rotatable shaft 26 in virtue of a plurality of belts 25, and in turn, the rotatable shaft 26 will drive the leaf blades 21 to rotate (as shown in FIG. 4), and moreover, a shock absorber 27 is placed under the stand 2. A lower cover 3 inserted in the reservoir 20 comprises a circular hole 30 in its center, an annular chamber 31 accommodating a proper quantity of steel bead 32 coated with lubricant in order to adhere to outer rim of the annular chamber 31 for lubrication and heat dissipation purposes, and a steel wire 33 penetrating a plurality of rolling beads 330 in series. A leaf-blade base 4 with a circumferential rim 45 fixedly installed on the connecting portion 22 of the stand 2 comprises three leaf blades 40, wherein a through hole 400 is disposed laterally to each leaf blade 40. A disk 41 is arranged on top of those leaf blades 40, wherein three flow-guide leaf blades 42 are disposed on top of the disk 41 with its bottom rim curled inwards to form an annular channel 43; and a drainpipe 44 is provided laterally to the annular channel 43. An upper cover 5 in inverse cone covered on the leaf-blade base 4 comprises three support posts 50 inside, wherein each support post 50 penetrates each through hole 400 of the leaf-blade base 4 respectively and to be fixed in the annular chamber 31 of the lower cover 3 for combining the upper and the lower cover 5, 3 to become a unity, so that the circumferential rim 45 of leaf-blade base 4 is sandwiched in a gap C. By the foregoing interlocking construction, the support posts 50 can slide freely in the through holes 400 of the leaf-blade base 4 and drive the upper and the lower cover 5, 3 to open or close the gap C in cooperation with the circumferential rim 45. Moreover, a conic flow-guide funnel 51 disposed on top of the upper cover 5 (as shown in FIG. 2, 3 and 5) contains a plurality of flow-guide layers 511 tapered downwards to form a stop board 510, wherein a sieve groove 512 is disposed between each pair of immediate neighboring flow-guide layers 511. A fender wall 6 in <-shape surrounding the stand 2 is supported by a plurality of lateral brackets 60, wherein two rolling wheels 600 are distributed to each bracket 60. The fender wall 6 can rotate freely among the brackets 60, and a brake block 61 is disposed on the fender wall 6 at its top and bottom face laterally and respectively. A scrape assembly 7 placed in inner side of the fender wall 6 contains a scrape knife 70 sitting on its top end, wherein the scrape knife 70 is attached closely to the inner side of the fender wall 6; an inlet 71 formed under the scrape knife 70 communicates with a lateral outlet 72 of the scrape assembly 7.

Figure 7:
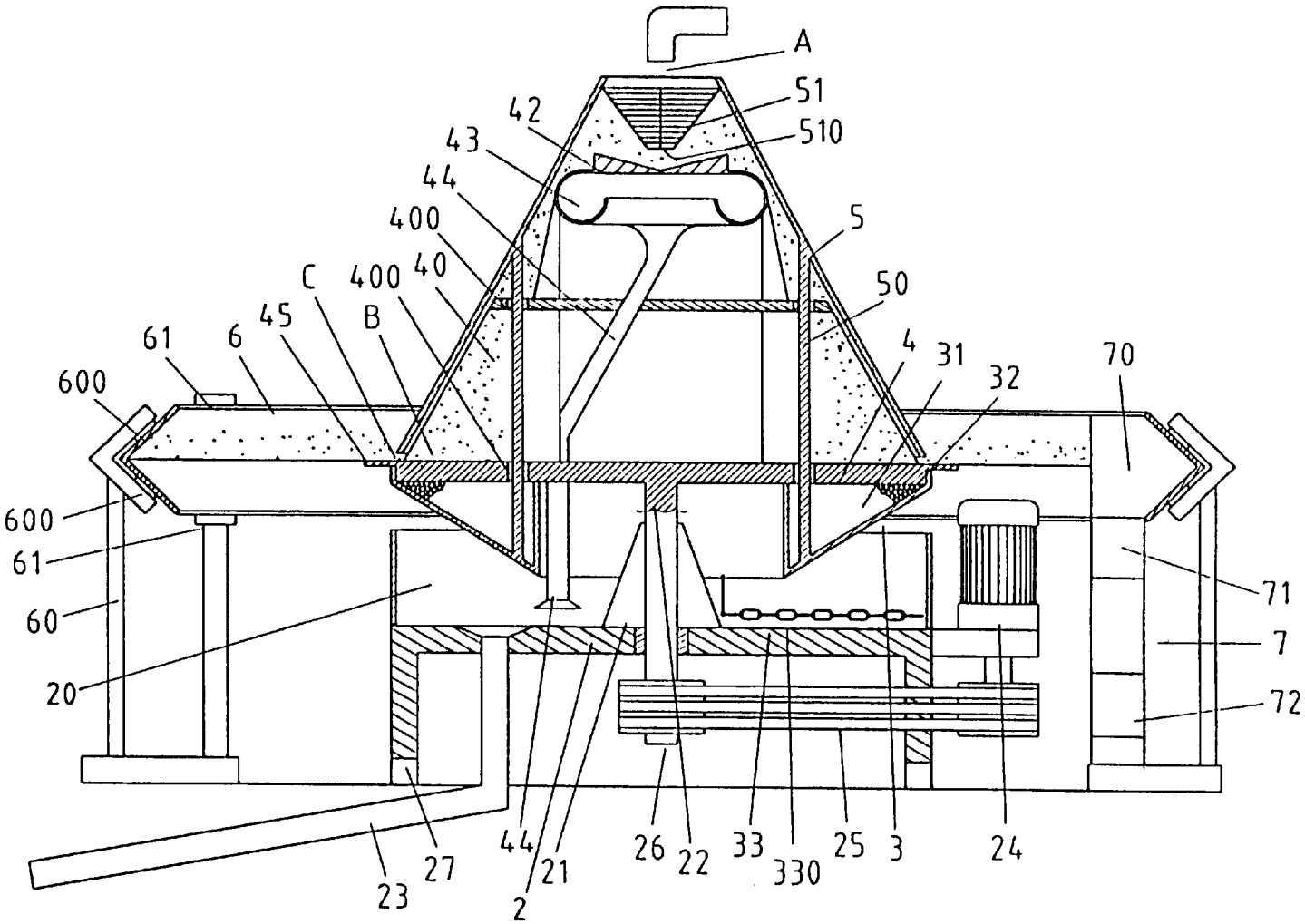
FIG. 7 is a schematic view showing open state of the gap between the upper and the lower cover of this invention.

In operation, as shown in FIG. 4, the motor 24 is started to rotate in high speed to drive the rotatable shaft 26 via the plurality of belts 25. Then, the entire leaf-blade base 4 is driven to rotate accordingly that in turn drives the upper and the lower cover 5, 3 to rotate via the support posts 50. Meanwhile, the steel beads 32 in the annular chamber 31 of the lower cover 3 create a balance force and a somewhat pressure pushing against the leaf-blade base 4 owing to a centrifugal force caused by high speed rotation, so that the upper and the lower cover 5, 3 move downwards following slide motion of the support posts 50 in the through holes 400 of the leaf-blade base 4 that enables the circumferential rim 45 of the leaf-blade base 4 to close the gap C between the upper and the lower cover 5, 3. When slurry A is poured into the upper cover 5, it is supposed to flow through the sieve groove 512 of the flow-guide funnel 51, while relatively bigger gravel will move along the flow-guide boards 511 upwards and outwards due to centrifugal force. The gravel smaller in size than the sieve groove 512 will enter the groove 512, on the contrary, the gravel will be thrown out off the flow-guide funnel 51 and stopped by stop boards and collected for volume-sorting purpose. The flow-guide leaf blades 42 function to accelerate the slurry A to slide into the upper cover 5, and the slurry A stays in the upper cover 5 will be separated because of the centrifugal force created by high-speed rotation of the flow-guide leaf blades 42 that the slurry residue B with larger specific gravity is separated to accumulate at the closed boundary between the upper cover 5 and the circumferential rim 45 of the leaf-blade base 4. When the slurry residue B accumulates to reach a designated quantity, the pressure created will become greater than that of the steel beads 32 to lift the upper cover 5 and its interlocked support posts 50 to drive the lower cover 3 movable in the through holes 400 of the leaf-blade base 4 upwards and open the gap C (as shown in FIG. 7). Therefore, the slurry residue B can be thrown out of the gap C along a tangent line that may push the fender wall 6 to rotate along the rolling wheels 600. In the meantime, as the slurry residue B attaches to inner face of the fender wall 6, the scrape knife 70 on top of the scrape assembly 7 will scrape the slurry residue B off to drop into the inlet 71 and to be removed through the outlet 72 for collection. Besides, whenever speed reduction of the fender wall 6 is desired, the brake blocks 61 will do the job. When the slurry residue B in the upper cover 5 is lessened to a critical quantity that creates a pressure smaller than that of the steel beads 32, the leaf-blade base 4 will be pushed by the steel beads 32 to descend the covers 5, 3 and return to the close state of the gap C. On the other hand, when the water separated in the upper cover 5 is filled over the height of the annular chamber 43, it will flow into the reservoir 20 via the drainpipe 44, or, in case the slurry residue B is produced too fast to be thrown out of the gap C in time, it can be drained through the drainpipe 44 as an alternative draining passage in order not to overflow out of the flow-guide funnel 51. The water and slurry residue B flows into the reservoir 20 and can be drained through the drainpipe 23 after undergoing rotation of the leaf blades 21 and scraping of the rolling beads 330 of the steel wire 33 to realize substantial and thorough separation of the slurry residue B from the water.

In short, this invention may be highlighted at:

Opening or closing the gap C of this invention depends on pressure produced according to quantity of the steel beads that permits continuous accumulation of slurry residue B until a balance state is obtained, and, as long as accumulation of the slurry residue B keeps going on, the gap C will be opened to vomit the residue. Also, rotation of the steel beads, which may be substituted with liquid metal, such as Mercury, for a better pressure value, is helpful for maintaining stable rotation of the upper and the lower cover.

From the abovesaid, merits of this invention can be summarized as:

1. A fully automatic separation operation can separate the residue from the water thoroughly and rapidly.
2. The flow-guide funnel can sieve and control size of separated residue.
3. Squeezing pressure come from centrifugal force of the steel beads can control thrown quantity and hydration ratio of the residue.
4. The pressure is adjustable by increasing or decreasing quantity of the steel beads or substituting with a liquid metal.

Although, this invention has been described in terms of preferred embodiments, it is apparent that numerous variations and modifications may be made without departing from the true spirit and scope thereof, as set forth in the following claims.

What is claimed is:

1. A centrifugal separator for separating solids and liquids in a slurry comprising:

a stand having a reservoir and a plurality of rotatable leaf blades disposed within said reservoir, said leaf blades including a connecting portion; a drain pipe and a motor disposed under said reservoir with said motor laterally displaced from said reservoir; a rotatable shaft connected to said leaf blades and a plurality of belts connecting said rotatable shaft and said motor for rotation of said shaft and leaf blades by said motor;

a lower cover including a bottom face and a circular hole formed in the center of said lower cover inserted in said reservoir; and an annular chamber having a top end, said annular chamber disposed internally of said lower cover; a lubricant and a quantity of steel bead coated with said lubricant disposed in said annular chamber; and a steel wire with a plurality of rolling beads disposed in series along said steel wire disposed at said bottom face of said lower cover;

a leaf blade base having a circumferential rim installed on and fixed to said connection portion and a plurality of leaf blades on top of said leaf blade base and including a plurality of through holes positioned laterally, and a disk having a bottom rim curled inwardly to form an annular channel disposed on top of said leaf blades, and a drain pipe disposed adjacent to said annular channel;

an upper cover disposed over said leaf blades, said upper cover having a plurality of support posts with said support posts penetrating said through holes in said leaf blades and fixedly disposed in said annular chamber; a flow guide funnel tapered downward with a plurality of flow guide layers and a sieve groove interposed between every two adjacent flow-guide layers;

a plurality of brackets, a plurality of rolling wheels, a plurality of brake blocks and a fender wall, said fender wall surrounding said stand and supported laterally by said plurality of brackets and wherein each bracket is provided with a plurality of said plurality of rolling wheels and wherein said brake blocks are disposed on said fender wall;

a scrape assembly having a top end, an inlet and a lateral outlet disposed on said inner side of said fender wall and including a scrape knife disposed on said top end wherein said inlet formed under said scrape knife communicates with said lateral outlet;

whereby the squeezing force of said steel beads comes from the centrifugal force owing to high speed rotation may be used to adjust the pressure pushing on said upper cover by the accumulating residue of the slurry A dropped into said upper cover for controlling the squeezed force and quantity of the thrown residue B and for collecting the same escaped from the gap C between said upper and said lower cover while the separated water will be drained through said drain pipe, the slurry being separable completely.

2. A centrifugal separator for separating solids and liquids in a slurry comprising:

a stand having a reservoir and a plurality of rotatable leaf blades disposed within said reservoir, said leaf blades including a connecting portion; a drain pipe and a motor disposed under said reservoir with said motor laterally displaced from said reservoir; a rotatable shaft connected to said leaf blades and a plurality of belts connecting said rotatable shaft and said motor for rotation of said shaft and leaf blades by said motor;

a lower cover including a bottom face and a circular hole formed in the center of said lower cover inserted in said reservoir; and an annular chamber having a top end, said annular chamber disposed internally of said lower cover; a liquid metal disposed in said annular chamber; and a steel wire with a plurality of rolling beads disposed in series along said steel wire disposed at said bottom face of said lower cover;

a leaf blade base having a circumferential rim installed on and fixed to said connection portion and a plurality of leaf blades on top of said leaf blade base and including a plurality of through holes positioned laterally, and a disk having a bottom rim curled inwardly to form an annular channel disposed on top of said leaf blades, and a drain pipe disposed adjacent to said annular channel;

an upper cover disposed over said leaf blades, said upper cover having a plurality of support posts with said support posts penetrating said through holes in said leaf blades and fixedly disposed in said annular chamber; a flow guide funnel tapered downward with a plurality of flow guide layers and a sieve groove interposed between every two adjacent flow-guide layers;

a plurality of brackets, a plurality of rolling wheels, a plurality of brake blocks and a fender wall, said fender wall surrounding said stand and supported laterally by said plurality of brackets and wherein each bracket is provided with a plurality of said plurality of rolling wheels and wherein said brake blocks are disposed on said fender wall;

a scrape assembly having a top end, an inlet and a lateral outlet disposed on said inner side of said fender wall and including a scrape knife disposed on said top end wherein said inlet formed under said scrape knife communicates with said lateral outlet;

whereby the squeezing force of said liquid metal comes from the centrifugal force owing to high speed rotation may be used to adjust the pressure pushing on said upper cover by the accumulating residue of the slurry A dropped into said upper cover for controlling the squeezed force and quantity of the thrown residue B and for collecting the same escaped from the gap C between said upper and said lower cover while the separated water will be drained through said drain pipe, the slurry being separable completely.

* * * * *